US006324806B1

(12) United States Patent
Rebman

(10) Patent No.: US 6,324,806 B1
(45) Date of Patent: Dec. 4, 2001

(54) COVERING FOR SUSPENDED CEILING GRID SYSTEM

(75) Inventor: Robert J. Rebman, Menasha, WI (US)

(73) Assignee: Acoustic Ceiling Products, L.L.C., Neenah, WI (US)

( * ) Notice: Subject to any disclaimer, the term of this patent is extended or adjusted under 35 U.S.C. 154(b) by 0 days.

(21) Appl. No.: 09/591,750

(22) Filed: Jun. 12, 2000

Related U.S. Application Data

(63) Continuation-in-part of application No. 09/385,157, filed on Aug. 30, 1999.

(51) Int. Cl.[7] ..... E04D 1/36

(52) U.S. Cl. ..... 52/465; 52/468; 52/469; 52/506.07; 52/716.6; 52/718.04

(58) Field of Search ..... 52/465, 468, 469, 52/506.06, 506.07, 716.6, 718.04, 717.05

(56) References Cited

U.S. PATENT DOCUMENTS

| | | | | |
|---|---|---|---|---|
| 2,500,377 | * | 3/1950 | Poupitch | 52/718.04 X |
| 3,000,474 | | 9/1961 | Friedman et al. . | |
| 3,263,388 | | 8/1966 | Bogert . | |
| 3,319,389 | * | 5/1967 | Levine | 52/309.1 |
| 3,355,206 | | 11/1967 | Valsvik . | |
| 3,512,819 | * | 5/1970 | Morgan et al. | 52/461 |
| 3,594,970 | | 7/1971 | MacGrath et al. . | |
| 3,844,086 | | 10/1974 | Radtke . | |
| 4,115,970 | | 9/1978 | Weinar . | |
| 4,128,978 | | 12/1978 | Beynon . | |
| 4,452,021 | | 6/1984 | Anderson . | |
| 4,485,605 | | 12/1984 | LaLonde . | |
| 4,569,175 | * | 2/1986 | Abciuk | 52/506.07 |
| 4,586,841 | | 5/1986 | Hunter . | |
| 4,718,213 | | 1/1988 | Butterfield . | |
| 4,722,161 | * | 2/1988 | Young | 52/506.07 |
| 4,742,662 | * | 5/1988 | Smith | 52/718.01 |
| 4,790,112 | * | 12/1988 | Wang | 52/460 |
| 4,838,002 | * | 6/1989 | Dajnko et al. | 52/475.1 |
| 4,848,054 | | 7/1989 | Blitzer et al. . | |
| 4,883,513 | | 11/1989 | Monson et al. . | |
| 4,893,444 | | 1/1990 | Ollinger et al. . | |
| 5,044,138 | | 9/1991 | Zaccardelli et al. . | |
| 5,259,162 | * | 11/1993 | Nicholas | 52/463 |
| 5,313,750 | | 5/1994 | Frecska et al. . | |
| 5,347,783 | | 9/1994 | Frecska et al. . | |
| 5,396,748 | | 3/1995 | Rogers . | |
| 5,414,969 | * | 5/1995 | Krejci et al. | 52/311.3 |
| 5,421,132 | | 6/1995 | Bischel et al. . | |
| 5,428,930 | | 7/1995 | Bagley et al. . | |
| 5,495,697 | | 3/1996 | Bischel et al. . | |
| 5,535,566 | | 7/1996 | Wilson et al. . | |
| 5,611,185 | | 3/1997 | Wilz . | |
| 5,836,127 | | 11/1998 | Clark et al. . | |

FOREIGN PATENT DOCUMENTS

| | | |
|---|---|---|
| 2520411 | 7/1983 | (FR) . |
| 2128222 | 4/1984 | (GB) . |
| 2142356 | 1/1985 | (GB) . |
| 2173227 | 10/1986 | (GB) . |

* cited by examiner

*Primary Examiner*—Beth A. Stephan
*Assistant Examiner*—Brian E. Glessner
(74) *Attorney, Agent, or Firm*—Michael Best & Friedrich LLP

(57) ABSTRACT

A covering for a suspended ceiling grid system particularly suited to be retrofitable onto an installed suspended ceiling grid system. The covering is preferably a plastic cap that can be snap fit onto the main runners of cross-tees of the installed suspended ceiling grid system, and the covering includes an elongate body having an opposed flange and lip which facilitate easy assembly and disassembly from a suspended ceiling grid system. The elongate body of the covering may be planar or non-planar.

20 Claims, 2 Drawing Sheets

COVERING FOR SUSPENDED CEILING GRID SYSTEM

This application is a continuation-in-part of application Ser. No. 09/385,157 filed Aug. 30, 1999.

FIELD OF THE INVENTION

The invention relates to a covering for a suspended ceiling grid system, and more particularly, to a cap to retrofit onto an existing suspended ceiling grid system.

BACKGROUND OF THE INVENTION

Ceiling grid systems for supporting tile panels, such as acoustical ceiling tiles, are used extensively in both new and remodeled building and room structures. Grid systems typically consist of main runners and cross-tees, having lateral supporting shoulders, that are arranged perpendicular to each other to form a rectangular pattern. After the grid is installed, the tile panels are placed onto the supporting shoulders of the runners and cross-tees. Such a grid system offers many advantages such as increasing a room's energy efficiency, improving a room's acoustics, enhancing the aesthetic value of a room, providing a means for lowering a ceiling, and allowing for the installation of electrical fixtures, pipes and duct work.

Ceiling grid systems are relatively inexpensive and easy to install as compared to a plaster ceiling. As a consequence, there is a continuing need to improve on the design and integrity of grid systems, particularly in light of the fact that many such systems are installed in commercial buildings requiring years of service, or installed by the do-it-yourself home owner.

In particular, there is a need to extend the life of the ceiling grid system. After a period of use, a suspended ceiling grid system, such as made from metal, may begin to degrade in that the components may start to rust or to flake, chip or peel paint or may be damaged such as by denting. Further, the color of the grid system as seen by a room's occupant may become discolored or faded over time. For example, in a food processing plant, flaking paint from a suspended ceiling grid system may be a safety and/or health hazard. In general, such a degraded ceiling grid system is also not aesthetically pleasing. Typically, such a degraded ceiling grid system had to be either repainted or removed/replaced with a new ceiling grid system, both at a high cost in labor and materials. Repainting may also be a temporary fix in that it is likely the paint will begin to flake or peel again.

Aesthetically, the color of a suspended ceiling grid system as seen by a room's occupants may also be outdated or there may be a need to change the decor of the room. Typically, suspended ceiling grid systems would have to be either repainted or replaced with the new desired colored ceiling grid system in order to change the color of the ceiling, again both at a high cost in labor and materials.

Accordingly, there exists a need for a device to cover a suspended ceiling grid system, such as an existing metal ceiling grid system, to change or retroactively change the appearance of the grid system without having to repaint or replace the grid system.

SUMMARY OF THE INVENTION

The invention provides a covering or cap for a suspended ceiling grid system. The covering is particularly suited to fit or retrofit onto an existing installed suspended ceiling grid system. The covering is preferably a plastic cap that can be snap fit onto the main runners and cross-tees of the grid system. The covering is comprised of an elongate body having a flange and a lip which are opposed and which facilitate easy assembly and disassembly from the suspended ceiling grid system. In a second embodiment of the invention, the elongated body is non-planar and has only a flange. In a third embodiment, the elongate body is non-planar and has both a lip and a flange.

It is a feature of the present invention to provide a covering for a suspended ceiling grid system.

It is another feature of the present invention to provide a covering for a suspended ceiling grid system to change the appearance of such a grid system.

It is another feature of the present invention to provide a covering for an installed ceiling grid system to change the appearance of such a grid system.

It is another feature of the present invention to provide a covering for an installed metal suspended ceiling grid system to change the appearance of such a grid system.

It is another feature of the present invention to provide a covering for a suspended ceiling grid system to change the color of the visible portions of the main runners and cross-ties.

It is another feature of the present invention to provide a covering for a degraded suspended ceiling grid system.

It is another feature of the present invention to provide a covering for an installed suspended ceiling grid system to eliminate rust, paint or the like from peeling or flaking from the grid system.

It is another feature of the present invention to provide a covering for an installed suspended ceiling grid system to cover the discolored or faded portion of the system visible to a room's occupant.

It is another feature of the present invention to provide a covering for a suspended ceiling grid system that is easy to install.

It is another feature of the present invention to provide a covering for a suspended ceiling grid system that is more cost effective than repainting or replacing the grid system.

It is another feature of the present invention to provide a covering for an installed suspended ceiling grid which can be snap fit onto the installed grid system.

It is another feature of the present invention to provide a cap for a suspended ceiling grid system that includes an elongate body having a flange and a lip that engages the grid system.

It is another feature of the present invention to provide a cap for a suspended ceiling grid system that includes a non-planar elongate body having a flange that engages the grid system.

It is another feature of the present invention to provide a cap for a suspended ceiling grid system that includes a non-planar elongate body having a flange and a lip that engages the grid system.

It is another feature of the present invention to provide a covering for a suspended ceiling grid system that is made from an extruded plastic.

Other features and advantages of the invention will become apparent to those of ordinary skill in the art upon review of the following detailed description, claims, and drawings.

Figures 1, 2, 3, 4, 5:
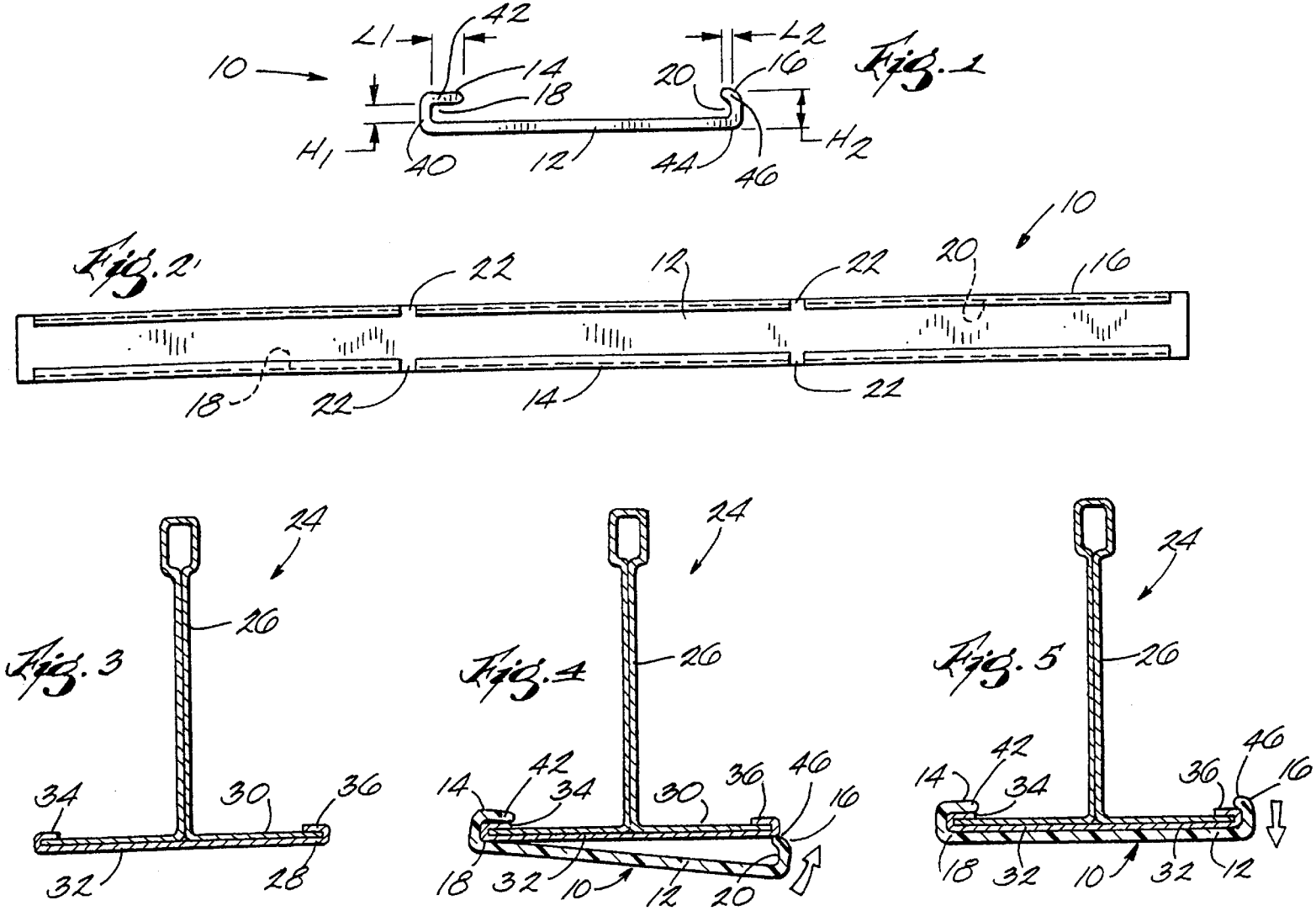
FIG. 1 is an end view of a covering for a suspended ceiling grid system embodying the invention.
FIG. 2 is a top view of the covering.
FIG. 3 is a cross-sectional end view of a runner of a suspended ceiling grid system.
FIG. 4 is a cross-sectional end view of the covering partially installed onto the runner of FIG. 3.
FIG. 5 is a cross-sectional end view of the covering fully installed onto the runner of FIG. 3.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring now to the drawings, there is shown in FIG. 1 a first embodiment of the invention, a covering or cap 10 for a suspended ceiling grid system. The covering 10 includes a central web portion 12 having two edges. A flange 14 is preferably integral with one edge and a lip 16 is preferably integral with the other edge. The flange 14 and the lip 16 are opposed and extend inwardly over the web portion 12 toward one another. The flange 14 cooperates with the web portion 12 to define a channel 18. The channel 18 is configured so as to house a portion of a main runner or a cross-tee as will be more fully explained below. The lip 16 cooperates with the web portion 12 to define a channel 20. The channel 20 is configured so as to house a portion of a main runner or a cross-tee as will be more fully explained below. At this point, it should be noted that the flange 14 and the lip 16 have lengths that extend inwardly over the web portion 12 and toward each other, with such lengths being unequal.

Preferably, the covering 10 is extruded from a plastic such as PVC. The longitudinal length of the covering 10 can be varied to accommodate varying dimensions of suspended ceiling grid systems or the covering 10 can be provided in bulk coiled form then cut by the installer to fit in a particular installation. Further, the covering 10 can be produced in varying colors to accommodate varying color schemes in the environment into which the covering 10 will be installed.

Referring now to FIG. 2, the covering 10 preferably includes notches 22 along its longitudinal length. The notches 22 allow perpendicularly adjacent coverings 10 to mate at an intersection of a main runner and a cross-tee, as is conventional in the art.

Turning now to FIG. 3, a runner 24, such as a main runner or a cross-tee, of a typical suspended ceiling grid system is shown. The runner 24 includes two sheets 26 and 28, typically metal, that are bent or folded to the configuration shown in FIG. 3. The sheet 26 is folded to a generally T-shaped configuration and the sheet 28 is bent around the T-shaped portion 30 of the sheet 26 so as to be generally C-shaped. Conventionally, a bottom face 32 of the sheet 28 had been painted or coated as this would have been the face that was visible to occupants of the room where it will be installed. It is this painting or coating that could degrade with time and flake, peel or rust. The runner 24 includes edges 34 and 36.

Turning now to the installation of the covering 10 depicted in FIG. 1, and shown in FIG. 4, the edge 34 of the runner 24 is positioned in the channel 18 of the flange 14. Upward pressure is then applied to the covering 10 on the web portion 12 near the lip 16 in the direction of the arrow in FIG. 4 such as by an installer's thumb. The upward pressure deforms the lip 16 enough to allow the covering 10 to snap into its installed position as is shown in FIG. 5 wherein the edge 36 is housed in the channel 20. In its installed position, the covering 10 is securely but removably positioned on the runner 24 by the flange 14 and the lip 16. It should be noted that the ease of installation of the covering 10 onto the runner 24 is particularly advantageous when installing the covering 10 on an existing suspended grid system where the installer is working overhead to install the covering 10. The snap fit covering 10 is both time efficient and installer friendly. If necessary, the covering 10 can be removed from the runner 24 by the application of downward pressure in the direction of the arrow in FIG. 5.

Turning back to FIG. 1, the flange 14 has a first portion 40 having a height dimension $H_1$ and a second portion 42 having a length dimension $L_1$. The lip 16 has a first portion 44 having a height dimension $H_2$ and a second portion 46 having a length dimension $L_2$. The height dimension $H_1$ and $H_2$ of the portions 40 and 44, respectively, are preferably equal so as to accommodate the typically uniform height dimension of the edges 34 and 36 of the runner 24. However, and as noted above, the length dimension $L_1$ and $L_2$ of the portions 42 and 46, respectively, are not equal. This is to enable the releasable snap fit action of the covering 10 onto the runner 24.

More specifically, the length dimension $L_2$ of the first portion 44 of the lip 16 must enable the releasable snap fit action for ease of installation of the covering 10. The length dimension $L_2$ is chosen so that the first portion 42 of the lip 16 is able to travel upwardly in the direction of the arrow in FIG. 4 and outwardly in a direction away from the web portion 12 thus allowing the lip 16 to travel around the edge 36. The lip then deforms or snaps back to its original non-deformed position when it has cleared the edge 36 to result in the edge 36 being housed in the channel 20.

An advantage of the covering 10 being preferably manufactured of a plastic is that health and safety regulations may be more easily met as opposed to repainting a degraded grid system.

Although particularly suited for a retrofit application, the covering 10 can also be provided with new or uninstalled ceiling grid systems to provide the consumer greater color options. For example, a new ceiling grid system could be sold in a standard color, such as white, then the consumer could select a covering 10 for the grid system in a color suitable for its installed environment.

Figure 6:
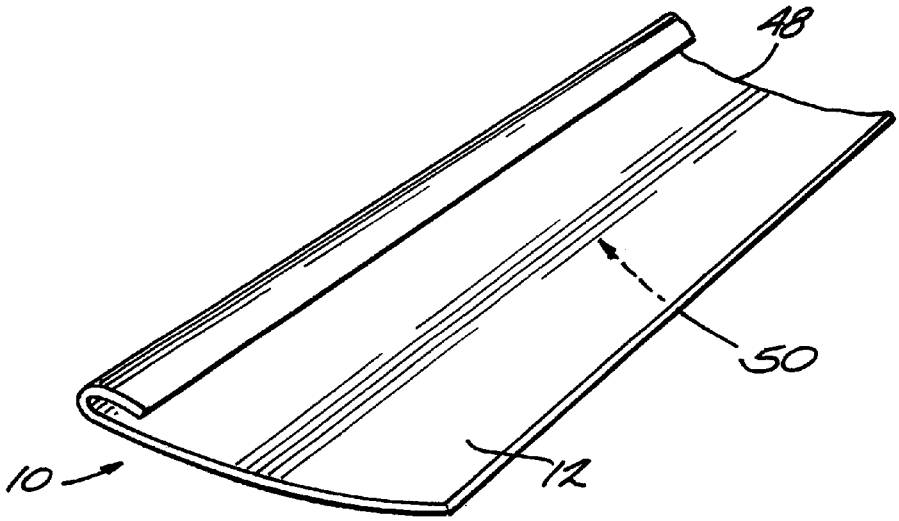
FIG. 6 is a perspective view of a second embodiment of the covering having a non-planar elongate body and flange.
Figure 7:
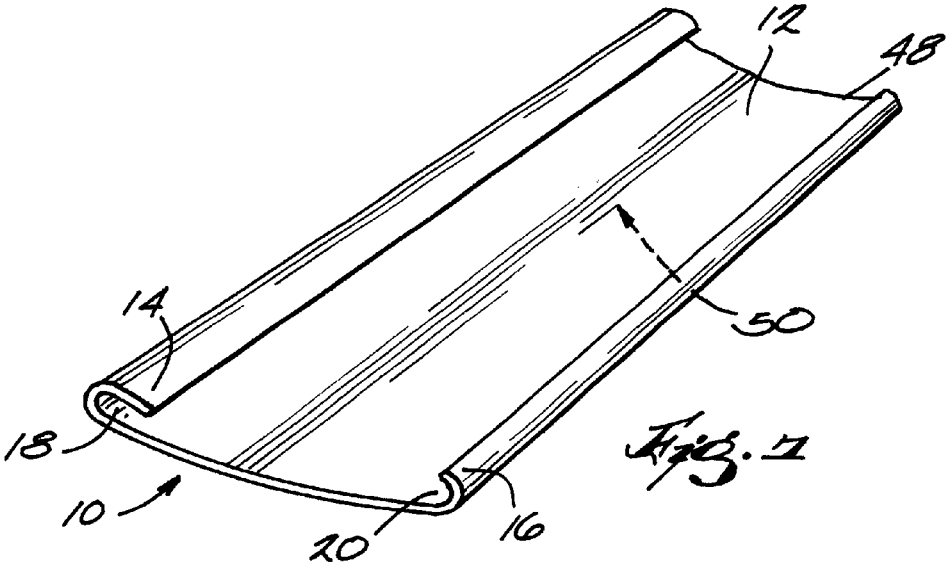
FIG. 7 is a perspective view of a third embodiment of the covering having a non-planar elongate body, flange and lip.

FIGS. 6 and 7 illustrate second and third embodiments of the invention, respectively wherein like reference numerals refer to like elements. The covering 10 in FIG. 6 includes a non-planar central web portion 48 having two edges and a middle portion 50. FIGS. 6 and 7 show the non-planar web portion 48 as being upwardly rounded, domed or arched. Alternatively, the web portion 48 could be downwardly arched. In the second embodiment shown in FIG. 6, the covering 10 has a flange 14, preferably integral with one edge. The flange 14 cooperates with the web portion 12 to define a channel 18. The channel 18 is configured so as to house a portion of a main runner or a cross-tee as explained above. The flange 14 has a length that extends inwardly over the web portion 48. The covering 10 can function without a lip 16 due to the non-planar design of the web portion 12, and is particularly suited for the edge of a ceiling installation where the ceiling abuts a wall.

FIG. 7 illustrates a third embodiment of the covering 10. The covering 10 of the third embodiment has an upwardly arched, non-planar web portion 48 having two edges and a flange 14 preferably integral with one edge. The web portion 12 of the third embodiment also includes a lip 16 preferably integral with the other edge. The lip 16 cooperates with the web portion to define a channel 20, similar to the channel 18 defined by the flange 14. The channel 20 is configured so as to house a portion of a main runner or a cross-tee as explained above. The flange 14 and the lip 16 have lengths that extend inwardly over the web portion 12 and toward each other, with such lengths being unequal.

The web portion 48 shown in FIGS. 6 and 7 is unitary. Alternatively, the web portion 48 could comprise two resilient segments connected or attached at a middle portion 50 in a pitched fashion. These two pitched, connected segments may be biased towards one another. When pressure is applied to the middle portion, i.e. where the two segments connect, the edges move away from each other. Accordingly, when pressure is released from the middle portion 50, the two inwardly biased segments move toward one another, back to their biased original position. The non-planar web portions 48 enhance the ease in which the coverings 10 can be installed.

The non-planar web portions 48 of the second and third embodiments shown in FIGS. 6 and 7 improve ease of installation of the covering 10. The arch of the web portion 48 allows an installer to simply slide his/her thumb down the middle portion 50 of the arched web portion 48 to force the outer edges of the covering to expand away from one another. In the case of the second embodiment, the expansion allows the covering 10 to snap around the runner, and for the flange 14 to secure the covering 10 in place. Once pressure is removed from the middle portion 50, the web portion 48 tends to return to its non-planar position, i.e., the outer edges tend to move towards one another, thereby further securing the covering 10 in the installed position.

When pressure is applied to the middle portion 50 of the third embodiment of the covering 10, the outer edges expand away from one another such that both the flange 14 and the lip 16 expand and snap around the runner 29. When pressure is removed, the outer edges tend to move towards one another to their biased, resting position, thereby gripping the runner 24. In its installed position, the covering 10 is securely but removably positioned on the runner 24 by the flange 14 and the lip 16.

I claim:

1. A covering for a runner of a suspended ceiling grid system, comprising:

an arcuate web portion having a first end and a second end; and a flange having a first portion of a first length and a second portion of a second length, said first portion of said flange connected to said first end, said second portion of said flange connected to said first portion of said flange, said second portion of said flange extending in the direction of said second end of said web portion, said flange and said web portion cooperating to define a first channel; and a lip having a first portion of a first length and a second portion of a second length, said first portion of said lip connected to said second end, said second portion of said lip connected to said first portion of said lip, said second portion of said lip extending in the direction of said first end of said web portion, said lip and said web portion cooperating to define a second channel;

wherein said first lengths of said first portions of said flange and said lip are equal and wherein said second length of said second portion of said flange is greater than said second length of said second portion of said lip.

2. The covering of claim 1 wherein said flange is integral with said web portion.

3. The covering of claim 1 wherein said lip is integral with said web portion.

4. The covering of claim 1 wherein said lip is deformable in a direction away from said web portion.

5. The covering of claim 1 wherein said covering is formed from an extruded plastic.

6. The covering of claim 1 wherein said covering further includes a plurality of notches spaced along said flange.

7. The covering of claim 1 wherein said covering further includes a plurality of notches spaced along said lip.

8. The covering of claim 1 wherein said web portion is elongate.

9. A covering for a suspended ceiling grid system having a plurality of runners, the runners each having a bottom face portion with a first edge and a second edge, said covering comprising:

a non-planar web portion having a first end and a second end;

a flange having a first portion and a second portion, said first portion of said flange connected to said first end of said web portion, said second portion of said flange connected to said first portion of said flange, said second portion of said flange extending in the direction of said second end of said web portion, said flange and said web portion cooperating to define a first channel adapted to house the first edge of the bottom face portion; and a lip having a first portion and a second portion, said first portion of said lip being connected to said second end, said second portion of said lip connected to said first portion of said lip, said second portion of said lip extending in the direction of said first end of said web portion, said lip and said web portion cooperating to define a second channel, said lip being deformable outwardly in a direction away from said web portion such that if the first edge of the bottom face is placed in said first channel, said lip is deformable outwardly to travel around the second edge of the bottom face and, after clearing the second edge, snap back into its non-deformed position with the second edge housed in the second channel, wherein said second length of said second portion of said flange is greater than said second length of said second portion of said lip.

10. The covering of claim 9 wherein said flange is integral with said web portion.

11. The covering of claim 9 wherein said lip is integral with said web portion.

12. The covering of claim 9 wherein said flange is non-deformable in a manner analogous to said lip.

13. The covering of claim 9 wherein said covering is formed of an extruded plastic.

14. The covering of claim 9 wherein said covering further includes a plurality of notches spaced along said flange.

15. The covering of claim 9 wherein said covering further includes a plurality of notches spaced along said lip.

16. The covering of claim 9 wherein said web portion is elongate.

17. A suspended ceiling grid system comprising:

a plurality of runners oriented perpendicular to one another, each of said runners having a bottom member that will be visible to a room's occupant when the suspended ceiling grid system is installed, said bottom member being generally planar and having a first edge and a second edge; and a cap snap fitable onto each of the plurality of runners, said cap having an arcuate web portion, a flange and a lip, said web portion having a first end and a second end, said flange having a first portion and a second portion, said first portion of said flange connected to said first end of said web portion, said second portion of said flange connected to said first portion of said flange, said second portion of said flange extending in the direction of said second end of said web portion, said flange and said web portion cooperating to define a first channel, said lip having a first portion and a second portion, said first portion of said lip being connected to said second end, said second portion of said lip connected to said first portion of said lip, said second portion of said lip extending in the direction of said first end of said web portion, said lip being deformable outwardly in a direction away from said web portion, and said lip and said web portion cooperating to define a second channel;

wherein said cap is installable onto a respective runner by insertion of said first edge of said bottom element into said first channel and application of pressure to said web portion to enable said lip to deform outwardly to travel around said second edge of said bottom element and, after clearing said second edge, snap back into its non-deformed position with said second edge housed in said second channel, and wherein said second portions of said flange and said lip are unequal in length.

18. The suspended ceiling grid system of claim 17 wherein said flange is non-deformable in a manner analogous to said lip.

19. The suspended ceiling grid system of claim 17 wherein said flange has a plurality of spaced notches along its length and said lip has a plurality of spaced notches along its length.

20. The suspended ceiling grid system of claim 17 wherein said cap is formed from an extruded plastic.

* * * * *